United States Patent [19]

Lenz

[11] Patent Number: 4,540,044

[45] Date of Patent: Sep. 10, 1985

[54] RADIATOR ARRANGEMENT

[75] Inventor: Werner Lenz, Muehlacker, Fed. Rep. of Germany

[73] Assignee: Sueddeutsche Kuehlerfabrik Julius Fr. Behr GmbH & Co. KG, Stuttgart, Fed. Rep. of Germany

[21] Appl. No.: 573,640

[22] Filed: Jan. 25, 1984

[30] Foreign Application Priority Data

Feb. 5, 1983 [DE] Fed. Rep. of Germany ..... 3303986

[51] Int. Cl.[3] ..... F28D 1/00

[52] U.S. Cl. ..... 165/149; 165/51; 165/67

[58] Field of Search ..... 165/51, 67, 149, 175; 180/68.4, 68.6

[56] References Cited

U.S. PATENT DOCUMENTS

| | | | |
|---|---|---|---|
| 1,374,394 | 4/1921 | Ross | 180/68.4 |
| 2,505,790 | 5/1950 | Panthofer | 165/149 X |
| 2,506,051 | 5/1950 | Young | 165/149 X |
| 4,382,464 | 5/1983 | Melnyk | 165/149 X |

FOREIGN PATENT DOCUMENTS

| | | | |
|---|---|---|---|
| 54815 | 6/1982 | European Pat. Off. | 165/149 |
| 2010231 | 2/1970 | France . | |
| 67832 | 11/1913 | Switzerland | 180/68.4 |

*Primary Examiner*—Stephen F. Husar

*Attorney, Agent, or Firm*—Barnes & Thornburg

[57] ABSTRACT

A radiator arrangement for water cooled combustion engines is disclosed, especially for use with commercial vehicles. The radiator cooling block, including the water boxes, are fastened at the vehicle frame by means of lateral support parts. The lateral support parts are provided with lateral mounting flanges which respectively extend over both ends of the water boxes and exhibit bores which are aligned with corresponding bores at the water boxes, whereby cotter pins or the like extending through the bores act as connecting pins to connect the parts together. This arrangement exhibits the advantage that the water boxes themselves are used as connecting traverse elements for the lateral support parts so that the lateral support parts and the water boxes form a stable frame construction which holds the soldered cooling block therebetween. Expensive soldered connections for the fastening of the lateral support parts is disposed with and the necessary reinforcing strength is formed by this frame construction.

16 Claims, 8 Drawing Figures

RADIATOR ARRANGEMENT

BACKGROUND AND SUMMARY OF THE INVENTION

The invention relates to a water/air heat exchanger or radiator arrangement for water cooled combustion engine, especially for commercial vehicles. The invention is especially related to such radiator arrangements wherein the cooling block, including the water boxes, is fastened by means of lateral support parts. It has been contemplated to provide such radiators for combustion engines, especially such radiators having plastic water boxes and a soldered cooling block, with lateral support parts which are anchored also through a solder connection at a tube sheet or tube floor of the water box. In the event such radiators are installed for commercial vehicles, especially of the kind of a medium or large size construction, it is generally necessary to fasten the radiator by means of the lateral support parts at the frame construction of the vehicle. Due to the actually experienced rough in-use conditions of such vehicles and because of the relatively large mass of the radiator, the fastening of the radiator according to such previously contemplated constructions is disadvantageously not always guaranteed.

The invention is based upon the problem to so construct a radiator of the above-mentioned kind that a secure and durable fastening at the vehicle is possible by means of the lateral support parts, without however requiring excessive construction expenditures.

The invention contemplates overcoming the above-mentioned problems by providing that the lateral support parts are respectively formed with lateral overextending mounting plates at their two ends for laterally gripping around the radiator water boxes and which mounting plates exhibit bores which are aligned with corresponding bores at the water boxes for accomodating insertion of aligning and connecting pins or the like. This arrangement exhibits the advantage that the water boxes are used as transverse connection parts for connecting the two lateral support parts so that the lateral support parts together with the water boxes form a stable frame construction which holds the soldered cooler block between them. The fastening strength of the lateral support parts, water boxes, and alignment-/connecting pins is sufficient to hold the radiator arrangement together and accomodate support at a vehicle frame without requiring any special or expensive soldering connection for the fastening of the lateral support parts to the remainder of the radiator.

It is especially advantageous according to preferred embodiments of the invention to form each mounting link with two parallel mounting plate parts which grip around the adjacently arranged water boxes at both sides and with the mounting plates parts being formed as respective strengthened or reinforced corner units with two of the connecting bores in each corner unit. This arrangement results in a high stability and facilitates the angular orientation of the water boxes and the lateral support parts during the assembly. In order not to impair the fastening connection of the tube sheet at the water boxes, which connection can be formed in an otherwise known manner, the bores in the water boxes are advantageously disposed outside of the flanges for the connection of the tube sheet.

In order to accomodate manufacturing tolerances and experienced thermal expansion movements during the use of the radiator arrangement on a commercial vehicle or the like, it is especially advantageous according to certain preferred embodiments to provide that the bores respectively on one end of the lateral support parts in the corresponding mounting plates are formed as oblong bores with their longest transverse dimension extending in the direction of the tube axes of the cooling block. Preferably, the oblong bores are provided at the respective upper ends of the lateral support parts to form a loose connection of the water box, while the connection with the lower water box is formed as a fixed bearing connection. This arrangement exhibits the advantage that despite a simple construction form, a tension-free elongation compensation is possible, something that was not the case with previously known constructions.

The connection alignment pins are preferably formed as threadless insertion or cotter pins which are secured by spring clamps which extend in a groove of the cotter pin. Such a construction part is available in the market. This arrangement exhibits the advantage that the assembly of the radiator does not necessitate any expensive threading procedures.

The new arrangement of this invention adapts itself especially for water boxes which are cast or manufactured out of plastic and which cannot, without additional means, be soldered with the metallic cooling box tube sheet. With water boxes made out of plastic it is advantageous to install a metal support shell in the bores so that the material of the water boxes is not damaged by the fastening forces at the connection/alignment pins.

Further objects, features, and advantages of the present invention will become more apparent from the following description when taken with the accompanying drawings which show, for purposes of illustration only, several embodiments in accordance with the present invention.

DETAILED DESCRIPTION OF THE DRAWINGS

Figure 2:
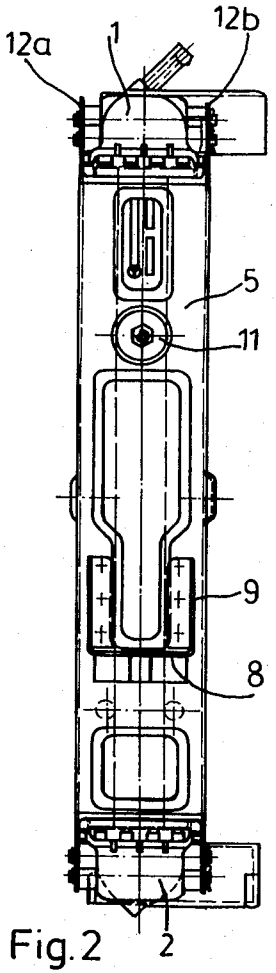
FIG. 2 is a side view of the radiator arrangement of FIG. 1 taken in the direction of the arrow II.
Figure 1:
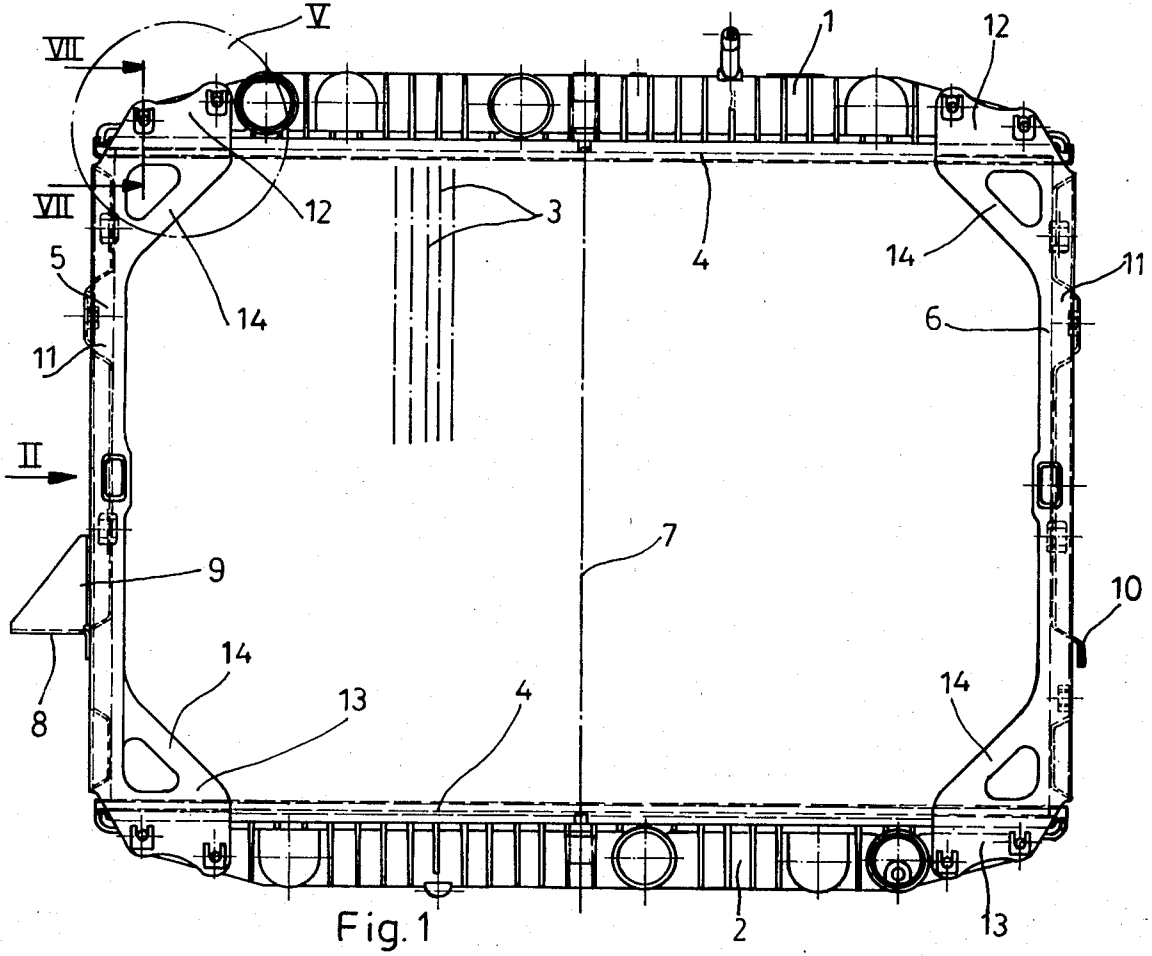
FIG. 1 is a frontal schematic view of a new radiator arrangement for commercial vehicles and the like, constructed in accordance with a preferred embodiment of the present invention.

In FIGS. 1 and 2, a water/air cooler or radiator for an commercial vehicle or the like is illustrated which includes an upper water box 1 formed of plastic material and a likewise plastic material lower water box 2, between which there is arranged a row of not-illustrated ribbed or finned tubes for the guidance of the cooling water arranged. The axes 3 of these tubes extend perpendicular to tubesheet fastening flanges 4 of the water boxes 1 and 2. The cooling block formed out of the ribbed tubes and the not shown tube sheets is manufactured by soldering connections. The tube sheets are respectively flangedly clamped with the flange for the water boxes, in a manner that is known.

Two lateral support parts 5 and 6 serve for fastening the cooler or radiator. These support parts are formed as profiled parts formed out of metal in the embodiments shown. According to other preferred embodiments, the support parts 5 and 6 are likewise formed out of suitable synthetic material. The lateral support parts 5 and 6 are basically constructed to be mirror symmetrical with respect to the middle plane 7 of the radiator, but with differently formed fastening projections at their lower parts. The lateral support part 5 is provided with a perpendicularly extending fastening plate 8 which is supported by means of two triangular formed strengthening angle parts 9 at the lateral sides. The plates 8 and the strengthening angle parts 9 can be welded or connected in another manner. The plates 8 serve during the fastening of the radiator to support the same at a part of the frame construction of the not-illustrated vehicle. The lateral support part 6 is provided with a profiled fastening hook 10 formed at an indentation. Both lateral support parts 5 and 6 exhibit pressed formations 11 which are ring-shaped and are located in the upper region of parts 5 and 6 and are provided with bores for the installation of fastening screws. The so profiled parts 5 and 6 are very stable.

Figure 4:
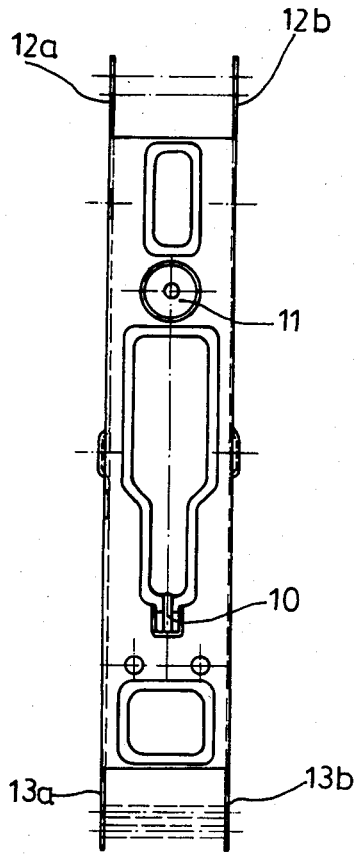
FIG. 4 is a view of the lateral support of FIG. 3 taken in the direction of the arrow IV.
Figure 3:
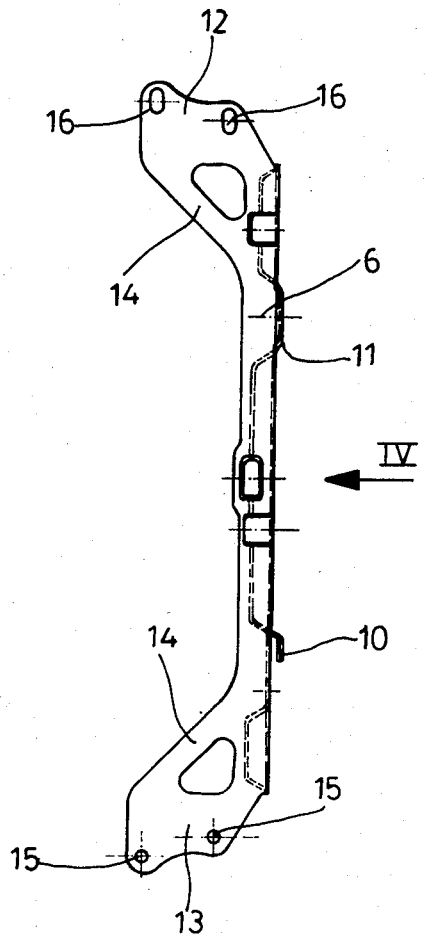
FIG. 3 is a view of a lateral support part of the radiator of FIG. 1.

The lateral parts 5 and 6 exhibit fastening flanges or plates 12 at their upper ends and fastening flanges 13 at their lower ends, which flanges 12 laterally grip the upper water box 1 and which flanges 13 laterally grip the lower water box 2. The fastening or mounting plate flanges 12, 13 consist respectively of two plate parts 12*a*, 12*b*, 13*a*, 13*b*, which extend respectively at the forward/rear of the water boxes and which are formed as strengthening angles by means of the arrangement of the diagonally extending connection part 14 formed as a reinforcement. The mounting flanges 12 and 13 are, as best shown in the illustration of FIGS. 3 and 4, provided respectively with bore pairs 15, 16, of which the bores 15 are cylindrical while the bores 16 are oblong holes which extend in the direction of axes 3 of the not-illustrated tubes.

Figure 5:
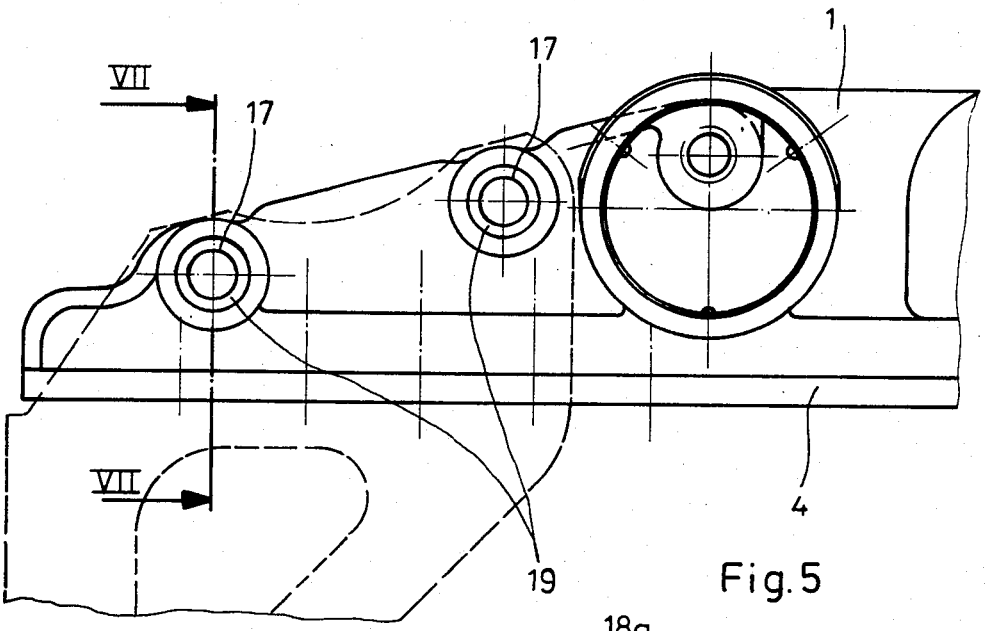
FIG. 5 is an enlarged detail illustration of the detail V in FIG. 1.
Figure 7:
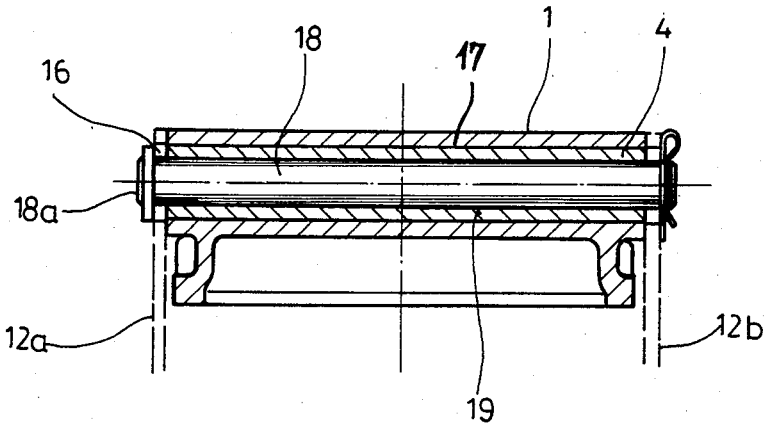
FIG. 7 is a sectional view through FIG. 5 along the line VII—VII.
Figure 8:
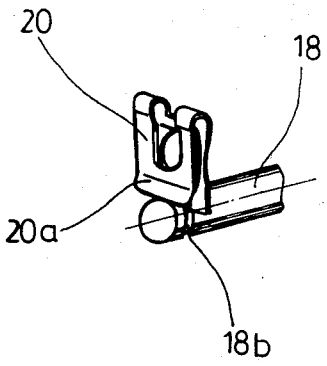
FIG. 8 shows finally a perspective illustration of the securing element for a cotter pin used in the arrangement of FIGS. 1–7.

The bores 15 and 16 in the lateral support parts 5, 6 are so arranged that they are aligned respectively with bores 17 in the water boxes 1 and 2, which in the illustrated embodiment are formed as cylindrical through extending openings so that the connecting pin 18, which is shown separately in FIGS. 7 and 8, extends through the bores 15, 16 and the aligned bores 17 at the water boxes 1 and 2. In this manner a secure and stable fastening of the lateral support parts 5 and 6 at the water boxes 1, 2 results. As shown in FIGS. 1 and 5, the bores 17 are at a distance from the fastening flanges 4 of the water boxes 1 and 2 so that the fastening of the lateral support parts 5 and 6 is independent of the fastening of the water boxes 1 and 2 at the cooling block. Especially in construction having plastic water boxes, this arrangement of the cooler is advantageous while it assures an extraordinary stability and the fastening is not made to be dependent upon soldering connections.

Figure 6:
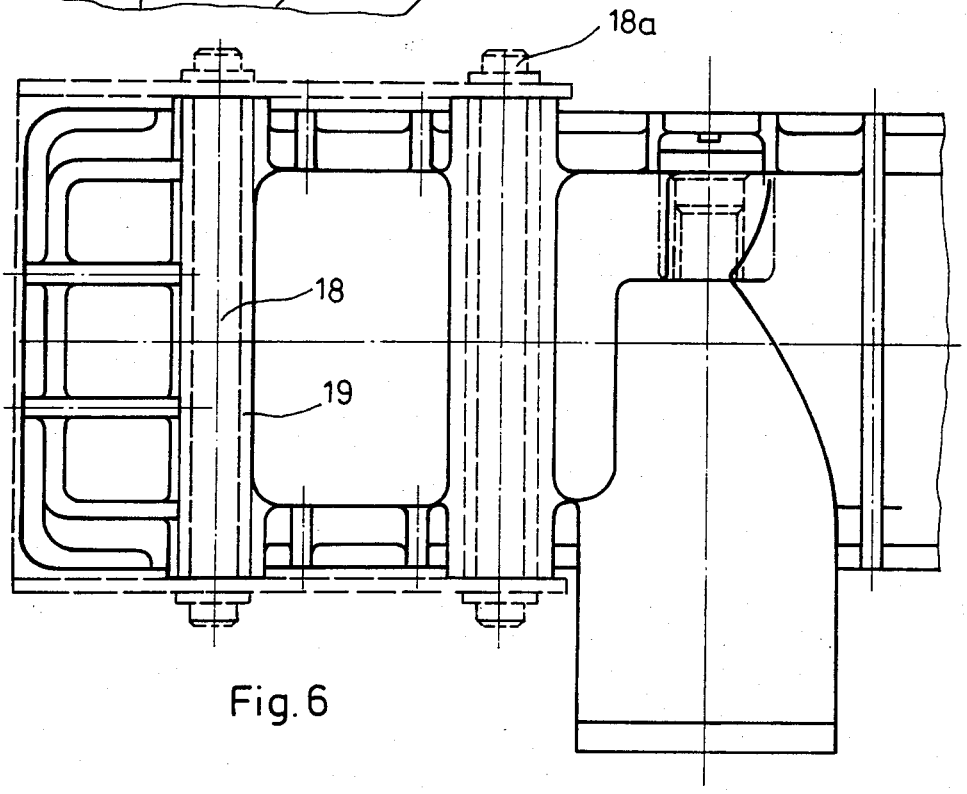
FIG. 6 is a top view of the enlarged detail of FIG. 5.

As can be seen in FIGS. 5 and 6 and especially FIG. 7, the fastening of the water boxes 1 and 2 with the fastening or mounting flanges 12 and 13 at the lateral support parts 5 and 6 are respectively provided as smooth cylindrical pins formed as cotter pins 18. Pins 18 are provided at one end with an abutment head 18*a* and at the other end with a circumferential groove 18*b*. The cotter pins 18 in the illustrated embodiment are guided through respective metallic protection shells 19. The inner diameter of the protection shells 19 is so conformed to the outer diameter of the cotter pins 18 that the same easily, but without any significant play, can extend through the bores 17 of the water box and through the bores 16, 15 of the mounting plates or flanges 12 at the fastening plate parts 12*a* and 12*b*. As can be seen in FIG. 7, the securement of the through extending cotter pins 18 is by means of spring clamps 20, which clamps are substantially U-shaped pieces with two spring legs extending in the respective grooves 18*b* and pressed therein and in the pressed in condition corresponding to FIG. 7 are secured through the forward securing parts 20*a*, which snaps over the facing end of the respective pin 18. This form of the spring clamp fastening is known for other clamping purposes. It permits an especially simple and threadless assembly with the novel radiator arrangement of the present invention.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. A radiator arrangement for water cooled combustion engines, especially for commercial vehicles having an upper and lower water box and a cooling block, wherein said cooling block includes a plurality of tubes for communicating fluid flow between said upper and lower water boxes, the improvement comprising:

said upper and lower water boxes being formed of a plastic material having cylindrical bores therethrough at each corner of said water boxes;

a pair of lateral support parts for fixedly attaching said upper and lower water boxes to the respective upper and lower portions of said cooling block, said lateral support parts including fastening flanges at the end of each lateral support part for laterally strapping to said upper and lower water boxes, said fastening means having like bores which align with said bores of upper and lower water boxes for providing a cylindrically continuous opening through which a smooth aligning pin can extend therethrough, thereby connecting said lateral support parts with said water boxes so that the combination thereof holds said cooler block between them, said lateral support parts further including a vehicle frame means for connecting said radiator arrangement to a vehicle frame.

2. Radiator arrangement according to claim 1, wherein each mounting flange means includes two parallel plate parts which encompass both sides of the respective water boxes.

3. Radiator arrangement according to claim 1, wherein the mounting flange means are provided with corner reinforcement and with respectively two of the bores at each of the upper and lower ends thereof.

4. Radiator according to the claim 1, wherein the water boxes include tube sheet connecting flanges for connecting the water boxes to a tube sheet which has been soldered together with the tubes, and wherein the bores in the water boxes are disposed at a spacing from the tube sheet connecting flanges.

5. Radiator arrangement according to claim 1, wherein the bores are formed as cylindrical openings extending through the mounting plate parts and the water boxes.

6. Radiator arrangement according to claim 1, wherein the bores at one end of the lateral support parts are formed as oblong holes with the maximum transverse dimension extending in the direction of the tube axes of the cooling block, to thereby accomodate manufacturing tolerance and thermal expansion induced relative adjustments of the lateral support parts and the cooling blocks and water boxes.

7. Radiator arrangement according to claim 6, wherein the oblong holes are provided at the respective upper mounting flange means of the lateral support parts.

8. Radiator arrangement according to claim 1, wherein the connecting and aligning pins are formed as insertable cotter pins and are secured with spring clamps which extend into respective grooves of the cotter pins.

9. Radiator arrangement according to claim 1, wherein respective metallic formed protection shells are inserted in the bores in the water boxes.

10. Radiator arrangement comprising:

an upper water box formed of synthetic plastic material and having a continuous bore therethrough at each corner;

a lower water box formed of synthetic plastic material and having a continuous bore therethrough at each corner;

a cooling block including a plurality of metallic tubes connected together by soldering to form a tube sheet;

flanged connecting means at the upper and lower boxes, for connecting the tube sheet to said upper and lower boxes at respective water flanges; and a pair of lateral profiled support parts disposed at opposite lateral sides of the tube sheet and having respective upper and lower end regions connected to the water boxes to form a stable radiator construction;

wherein said water boxes and flanged connecting means have aligned bores for providing a cylindrically continuous opening;

wherein said lateral support parts are connected to the water boxes by means of connecting pins inserted in aligned bores through flange plates of the lateral support parts and through the water boxes.

11. Radiator arrangement according to claim 10, wherein the flange plates are formed as parallel plates which sandwich the respective water boxes therebetween.

12. Radiator arrangement according to claim 10, wherein at least some of the bores are of oblong shape to accomodate manufacturing tolerances and thermal expansion of the parts being connected.

13. Radiator arrangement according to claim 10, wherein metallic sleeves are disposed in the bores through the water boxes to accomodate the connecting pins and limit wear on the walls of said bores through the water box.

14. Radiator arrangement according to claim 11, wherein metallic sleeves are disposed in the bores through the water boxes to accomodate the connecting pins and limit wear on the walls of said bores through the water box.

15. Radiator arrangement according to claim 14, wherein at least some of the bores are of oblong shape to accomodate manufacturing tolerances and thermal expansion of the parts being connected.

16. Radiator arrangement according to claim 11, wherein each end of each lateral support part is provided with two bores and corresponding connecting pins extending therethrough.

* * * * *